US008414370B2

(12) United States Patent
Nguyen

(10) Patent No.: US 8,414,370 B2
(45) Date of Patent: Apr. 9, 2013

(54) GAMING SYSTEM AND METHOD OF GAMING

(75) Inventor: Hung Ngoc Nguyen, Sefton (AU)

(73) Assignee: Aristocrat Technologies Australia Pty Limited (AU)

( * ) Notice: Subject to any disclaimer, the term of this patent is extended or adjusted under 35 U.S.C. 154(b) by 808 days.

(21) Appl. No.: 12/356,977

(22) Filed: Jan. 21, 2009

(65) Prior Publication Data

US 2009/0209318 A1 Aug. 20, 2009

(30) Foreign Application Priority Data

Jan. 21, 2008 (AU) ..... 2008900267

(51) Int. Cl.
*A63F 9/24* (2006.01)

(52) U.S. Cl.
USPC ..... 463/10; 463/16; 463/17; 463/18; 463/20

(58) Field of Classification Search ..... 463/10–13, 463/16–22
See application file for complete search history.

(56) References Cited

U.S. PATENT DOCUMENTS

| | | | | |
|---|---|---|---|---|
| 7,607,980 | B2 * | 10/2009 | Masci et al. | 463/20 |
| 2004/0033824 | A1 | 2/2004 | Fitzhugh | |
| 2004/0092299 | A1 | 5/2004 | Gauselmann | |
| 2005/0026679 | A1 * | 2/2005 | Lucchesi et al. | 463/20 |
| 2006/0281527 | A1 | 12/2006 | Dunaevsky et al. | |
| 2007/0111782 | A1 | 5/2007 | Adams et al. | |
| 2007/0275778 | A1 | 11/2007 | Fong et al. | |
| 2008/0070672 | A1 * | 3/2008 | Inamura | 463/20 |

FOREIGN PATENT DOCUMENTS

| | | | |
|---|---|---|---|
| AU | 2007202816 | A1 | 2/2008 |
| AU | 2008252034 | A | 7/2009 |
| JP | 2003117162 | A | 4/2003 |

* cited by examiner

*Primary Examiner* — Hsien Ming Lee
(74) *Attorney, Agent, or Firm* — McAndrews, Held & Malloy, Ltd.

(57) ABSTRACT

A gaming system, comprising a game controller arranged to control play of a game, and a display arranged to display a representation of play of the game, the game controller being arranged to select a plurality of symbols from a set of symbols for play of the game, to control the display to display a plurality of the selected symbols in rows and columns, to determine a game outcome based on patterns of symbols in the rows and columns, and also being arranged to generate a feature game in response to a trigger condition, and determine an outcome of the feature game depending on the occurrence of a non-linear pattern of symbols.

59 Claims, 16 Drawing Sheets

| | 1 | 2 | 3 | 4 | 5 |
|---|---|---|---|---|---|
| T | Q | Q | ↑ | ↑ | |
| C | | | Q | ↑ | |
| B | | | ↑ | Q | |

| | 1 | 2 | 3 | 4 | 5 |
|---|---|---|---|---|---|
| T | Q | Q | Q | Q | |
| C | | | | | |
| B | | | | | |

| | | | | |
|---|---|---|---|---|
| A | A | A | A | |
| A | | | A | |
| A | A | A | A | |

Figure 25

| | | | | |
|---|---|---|---|---|
| | | A | | |
| | A | | A | |
| A | | | | A |
| | A | | A | |
| | | A | | |

Figure 26

| | | | | |
|---|---|---|---|---|
| | A | A | | |
| A | | | A | |
| | A | A | | |

Figure 27

| | | | | |
|---|---|---|---|---|
| | | A | | |
| | A | | A | |
| A | A | A | A | A |

Figure 28

GAMING SYSTEM AND METHOD OF GAMING

RELATED APPLICATIONS

This application claims priority to Australian Patent Application No. 2008900267, having a filing date of Jan. 21, 2008, which is incorporated herein by reference in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

It is known to provide a gaming system which comprises a game controller arranged to randomly select and cause the display of a set of symbols from a predetermined set of symbols and to determine a game outcome, such as a game win, based on the displayed symbols. Such gaming systems may commonly be implemented as a stepping machine provided with reels with each reel carrying several symbols of the set, or a video machine wherein selected symbols are displayed on virtual reels on a graphical display device. Win outcomes can occur based on symbols appearing on one or more horizontal lines, diagonal lines, or any other predetermined way. Typically, five reels across are provided on the display (although less or more may be provided). Each reel or virtual reel display is three symbols high in the display window for the reel (although, again, this may be more or less symbols high).

In known gaming systems, a player can choose whether or not to wager on one or more win "win lines" for each play of the game. A win line is a predetermined line through an arrangement of symbol positions in the row and column array provided by the reels. In known gaming systems, many different win lines are available. In a typical gaming system, with a five column by three row display, win lines 1, 2 and 3 are designated as the horizontally extending lines comprising the centre row, top row and bottom row, respectively. Win lines may be designated as extending from bottom left corner to top right corner of the reel display, and from top right corner to bottom left corner of the reel display (e.g. win lines 4 and 5). Many other win lines are known in the art. Typically, if a player does not bet on a particular win line, even if a winning symbol combination comes up on that win line he may not win a prize.

It is known to provide gaming systems which play a base game (which may determine a game outcome based on selection from pre-determined set of symbols) and a feature game. The feature game may be generated as a result of a game outcome of the base game. For example, a feature game may comprise one or more "free games" based on a pre-determined combination of symbols occurring as a result of a play of a base game, or some other pre-determined criteria.

Whilst such gaming systems provide users with their enjoyment, the need exists for alternative gaming systems in order to maintain or increase player enjoyment. It would be useful to provide an extra way of awarding prizes to a player, for example or to provide extra variations or new games which are visually interesting and attractive to players.

BRIEF SUMMARY OF THE INVENTION

In accordance with a first aspect, the present invention provides a gaming system, comprising a game controller arranged to control play of a game, and a display arranged to display a representation of play of the game, the game controller being arranged to select a plurality of symbols from a set of symbols for play of the game, to control the display to display a plurality of the selected symbols in rows and columns, to determine a game outcome based on patterns of symbols in the rows and columns, and also being arranged to generate a feature game in response to a trigger condition, and determine an outcome of the feature game depending on the occurrence of a non-linear pattern of symbols.

It is an advantage of at least one embodiment of the invention, that offering a feature in which an outcome of the game depends on the occurrence of a different "win pattern", gives a further prize winning opportunity for a player and increases interest and entertainment in the gaming system.

In an embodiment, the non-linear pattern comprises a "stair combination". A stair combination comprises a plurality of symbols displayed in a stair pattern, including at least one step and extending from left to right in the row and column arrangement of symbols. A "step" is when the pattern moves from one row to an adjacent row at the same time as moving from one column to an adjacent column. The stair combination may be a "down" stair combination (step down from left to right) or an "up" stair combination (step up from left to right). A stair combination ends on either a lower (step down) or upper (step up) row and starts on a lower (step up) or higher (step down) row, from left to right in the arrangement of rows and columns.

In an embodiment, the non-linear pattern of symbols comprises a "pyramid combination". A pyramid combination comprises a plurality of symbols displayed in a pyramid pattern. A "normal" pyramid includes at least one step up in the pattern of symbols and one step down in the pattern of symbols extending from left to right. An "inverted pyramid" includes at least one step down and one step up extending from left to right in the pattern of symbols. A pyramid has a base, comprising at least two symbols on the same row, and a top, comprising at least one symbol on a row different from the base symbols row. The pyramid may be a "flattened pyramid" in which case the top includes at least two symbols on the same row.

In at least an embodiment, providing a pyramid or stair combination or other non-linear pattern as a feature provides an easily identifiable pattern by which a player can identify the game outcome. It also provides an interesting graphical feature for the player to look for.

In an embodiment, the non-linear pattern may include symbols which are "stacked" in the same column. For example, in "reel" games, rows and columns of symbol positions are represented on the display as a reel bearing the symbols, or are on an actual reel bearing the symbols. It is known in some reel games, to have "stacked" symbols, wherein the same symbol may be included two or more times on the same reel. In an embodiment, the non-linear pattern may include stacked symbols within the pattern.

In an embodiment, the non-linear pattern is a rectangular pattern of symbols. In an embodiment, the non-linear pattern is a rhombus of symbols. In an embodiment, the non-linear pattern is a hexagon pattern. In an embodiment, the non-linear pattern is a triangle pattern of symbols. The symbols in the pattern may be the same symbols, or different symbols. The non-linear pattern of symbols may be any non-linear pattern.

In an embodiment, the feature game may comprise one or more separate games played in addition to a base game. The base game may, for example, be played for game outcomes based on conventional win line patterns. The feature game in this embodiment is then played for game outcomes which include a game outcome depending on the occurrence of a non-linear pattern of symbols. The game outcome of the feature game may also include other outcomes, which may be standard win lines.

In an embodiment, the feature game may be played as a feature within a base game. The base game may, for example, be played for game outcomes including standard win lines, and when the feature is generated, the standard game will have at least one additional game outcome depending on the occurrence of a non-linear pattern of symbols.

An advantage of at least an embodiment of the invention, is to provide new win patterns which are played independently of the existing win line systems. The feature game may be played as a variation of a base game (as discussed above) or as a separate feature game. The provision of new win line patterns played as a variation on a base game or as a separate feature game advantageously maintains player interest and excitement.

In an embodiment, if a non-linear pattern of symbols is achieved as an outcome, the game controller is arranged to adjust the position of at least one of the symbols to vary the pattern. In an embodiment, the game controller is arranged to control the display to show the adjusted pattern. In an embodiment, the game controller is arranged to adjust the non-linear pattern to a line pattern.

In an embodiment, the game controller is arranged to control the display to display a graphical character moving over the non-linear pattern of symbols. The graphical character may be associated with a prize award to the player. The graphical character may be any character, e.g. a representation of an animal, a human being, cartoon character or any other character.

In an embodiment, the trigger condition may be any trigger condition. In an embodiment, the game controller may detect an amount of credit input via a player interface on actuation of the player interface to indicate that the credit has been placed for the feature. The feature will then be generated. In an embodiment, the trigger condition may comprise an arrangement of symbols having been selected in the game.

In an embodiment, the game controller is arranged to control the display so that a line is displayed through or over the non-linear pattern of symbols.

In an embodiment, the rows and columns of symbol positions are represented on the display as a reel bearing the symbols, or is an actual reel bearing the symbols.

In accordance with a second aspect, the present invention provides a method of gaming, comprising the steps of selecting a plurality of symbols from a set of symbols for play of a game, displaying at least a plurality of the selected symbols in rows and columns of symbol positions, determining a game outcome based on patterns of symbols in the rows and columns of symbol positions, and playing a feature game in response to a pre-determined trigger condition being satisfied, an outcome of the feature game depending on the occurrence of a non-linear pattern of symbols.

In accordance with a third aspect, the present invention provides a computer program comprising instructions for controlling a computer to implement a gaming system in accordance with the first aspect of the invention.

In accordance with a fourth aspect, the present invention provides a computer readable medium providing a computer program in accordance with the third aspect of the invention.

In accordance with a fifth aspect, the present invention provides a data signal comprising a computer program in accordance with the third aspect of the invention.

In accordance with a sixth aspect, the present invention provides a gaming system, comprising a game controller arranged to control play of a game, and a display arranged to display a representation of play of the game, the game controller being arranged to select a plurality of symbols from a set of symbols for play of the game, to control the display to display a plurality of the selected symbols in rows and columns, to determine a game outcome based on patterns of symbols in the rows and columns, at least one of the game outcomes depending on the occurrence of a pyramid combination of symbols.

In accordance with a seventh aspect, the present invention provides a method of gaming, comprising the steps of selecting a plurality of symbols from a set of symbols for play of a game, displaying at least a plurality of selected symbols in rows and columns as symbol positions, determining a game outcome based on patterns of symbols in the rows and columns of symbol positions, at least one of the game outcomes depending on the occurrence of a pyramid combination of symbols.

In accordance with an eighth aspect, the present invention provides a computer program comprising instructions for controlling a computer to implement a gaming system in accordance with the sixth aspect of the invention.

In accordance with a ninth aspect, the present invention provides a computer readable medium providing a computer program in accordance with the eighth aspect of the invention.

In accordance with a tenth aspect, the present invention provides a data signal comprising a computer program in accordance with the eighth aspect of the invention.

In accordance with an eleventh aspect, the present invention provides a gaming system, comprising a game controller arranged to control play of a game, and a display arranged to display a representation of play of the game, the game controller being arranged to select a plurality of symbols from a set of symbols for play of the game, to control the display to display a plurality of the selected symbols in rows and columns, and to determine a game outcome based on patterns of symbols in the rows and columns, at least one outcome of the game depending on the occurrence of a stair combination of symbols.

In accordance with a twelfth aspect, the present invention provides a method of gaming, comprising the steps of selecting a plurality of symbols from a set of symbols for play of a game, displaying at least a plurality of a selected symbols in rows and columns of symbol positions, determining a game outcome based on patterns of symbols in the rows and columns of symbol positions, at least one outcome of the game depending on the occurrence of a stair combination of symbols.

In accordance with a thirteenth aspect, the present invention provides a computer program comprising instructions for controlling a computer to implement a game in accordance with an eleventh aspect of the invention.

In accordance with a fourteenth aspect, the present invention provides a computer readable medium providing a computer program in accordance with the thirteenth aspect of the invention.

In accordance with a fifteenth aspect, the present invention provides a data signal comprising a computer program in accordance with the thirteenth aspect of the invention.

In accordance with a sixteenth aspect, the present invention provides a game controller for a gaming system, the game controller being arranged to select a plurality of symbols from a set of symbols for play of a game, to control a display to display a plurality of the selected symbols in rows and columns, to determine a game outcome based on patterns of symbols in the rows and columns, and also being arranged to generate a feature game in response to a trigger condition, and determine an outcome of the feature game depending on the occurrence of a non-linear pattern of symbols.

In accordance with a seventeenth aspect, the present invention provides a computer program, comprising instructions for controlling a computer to implement a game controller in accordance with the sixteenth aspect of the invention.

In accordance with an eighteenth aspect, the present invention provides a computer readable medium, providing a computer program in accordance with the seventeenth aspect of the invention.

In accordance with a nineteenth aspect, the present invention provides a data signal, comprising a computer program in accordance with the seventeenth aspect of the invention.

In accordance with a twentieth aspect, the present invention provides a game controller for a gaming system, the game controller being arranged to select a plurality of symbols from a set of symbols for play of a game, to control a display to display a plurality of the selected symbols in rows and columns, and to determine a game outcome based on patterns of symbols in the rows and columns, at least one of the game outcomes depending on the occurrence of a pyramid combination of symbols.

In accordance with a twenty-first aspect, the present invention provides a computer program, comprising instructions for controlling a computer to implement a game controller in accordance with the twentieth aspect of the invention.

In accordance with a twenty-second aspect, the present invention provides a data signal, comprising a computer program in accordance with the twentieth aspect of the invention.

In accordance with a twenty-third aspect, the present invention provides a computer readable medium providing a computer program in accordance with the twentieth aspect of the invention.

In accordance with a twenty-fourth aspect, the present invention provides a game controller for a gaming system, the game controller being arranged to select a plurality of symbols from a set of symbols for play of a game, to control a display to display a plurality of the selected symbols in rows and columns, and to determine a game outcome based on patterns of symbols in the rows and columns, at least one outcome of the game depending on the occurrence of a stair combination of symbols.

In accordance with a twenty-fifth aspect, the present invention provides a computer program, comprising instructions for controlling a computer to implement a game controller in accordance with the twenty-fourth aspect of the invention.

In accordance with a twenty-sixth aspect, the present invention provides a computer readable medium, providing a computer program in accordance with the twenty-fifth aspect of the invention.

In accordance with a twenty-seventh aspect, the present invention provides a data system, comprising a computer program in accordance with the twenty-fifth aspect of the invention.

In accordance with a twenty-eight aspect, the present invention provides a gaming system, comprising a game controller arranged to control play of the game, and a display arranged to display a representation of play of the game, the game controller being arranged to select a plurality of symbols from a set of symbols for play of the game, to control the display to display a plurality of the selected symbols in rows and columns, to determine a game outcome based on patterns or symbols in the rows and columns, and to determine an outcome of the game depending on the occurrence of a pattern of symbols including two or more symbols in a column.

In accordance with a twenty-ninth aspect, the present invention provides a computer program, comprising instructions for controlling a computer to implement a gaming system in accordance with the twenty-eighth aspect of the invention. In accordance with a thirtieth aspect, the present invention provides computer readable medium, providing a computer program in accordance with the twenty-ninth aspect of the invention.

In accordance with a thirty-first aspect, the present invention provides a data signal, comprising a computer program in accordance with the twenty-ninth aspect of the invention.

In accordance with a thirty-second aspect, the present invention provides a game controller for a gaming system, arranged to select a plurality of symbols from a set of symbols for play of a game, and to control a display to display a plurality of the selected symbols in rows and columns, to determine a game outcome based on patterns or symbols in the rows or columns and to determine an outcome of the game depending on the occurrence of a pattern of symbols including two or more symbols in a column. In accordance with a thirty-third aspect, the present invention provides a computer program, comprising instructions for controlling a computer to implement a game controller in accordance with the thirty-second aspect of the invention. In accordance with a thirty-fourth aspect, the present invention provides a computer readable medium, providing a computer program in accordance with the thirty-third aspect of the invention.

In accordance with a thirty-fifth aspect, the present invention provides a data-signal, comprising a computer program in accordance with the thirty-third aspect of the invention.

BRIEF DESCRIPTION OF SEVERAL VIEWS OF THE DRAWINGS

Features and advantages of the present invention will become apparent from the following description of embodiments thereof, by way of example only, with reference to the accompanying drawings, in which;

FIGS. 25 to 28 are schematic representations of example displays generated by a gaming system in accordance with an embodiment of the present invention, illustrating further feature patterns.

DETAILED DESCRIPTION OF THE INVENTION

Figure 8:
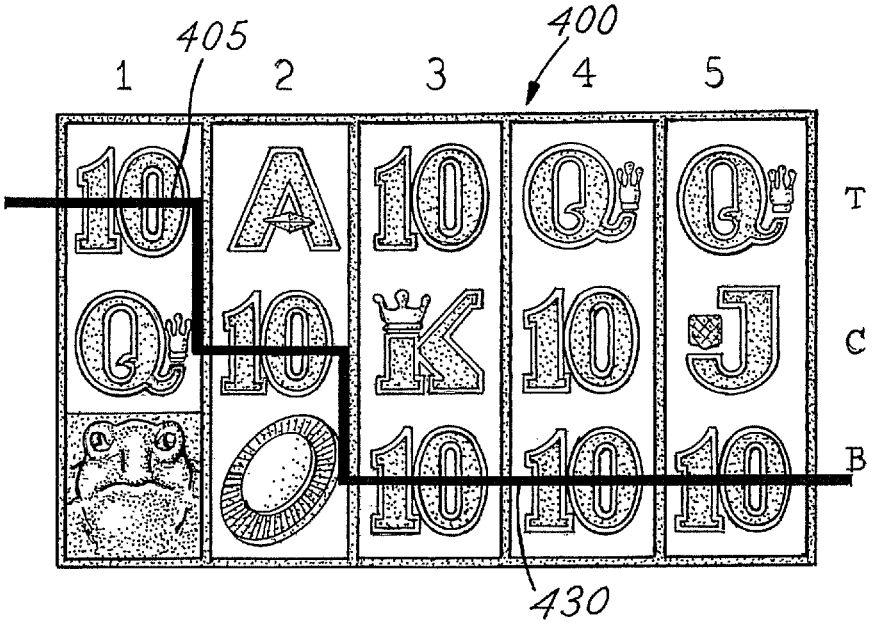
FIGS. 8 through 12 are example displays generated by a gaming system in accordance with an embodiment of the present invention, illustrating various feature game patterns.

Referring to the drawings, there is shown a gaming system arranged to implement a game in which a plurality of symbols from a set of symbols are selected and displayed in symbol positions in rows and columns. In this embodiment, the gaming system is also arranged to play a feature, in which a prize may be awarded for non-linear patterns of symbols. FIG. 8, for example, illustrates a display 400 which shows a stair down pattern 405 of "10" symbols. In standard slot games, this type of pattern is normally not a winning pattern. In this feature, the player is given a chance to play for this type of pattern to win a prize. This has the advantage of providing further opportunities for players to win prizes, providing further entertainment, and a graphically interesting, easy to understand win pattern.

The gaming system can take a number of different forms.

In a first form, a stand alone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Figure 1:
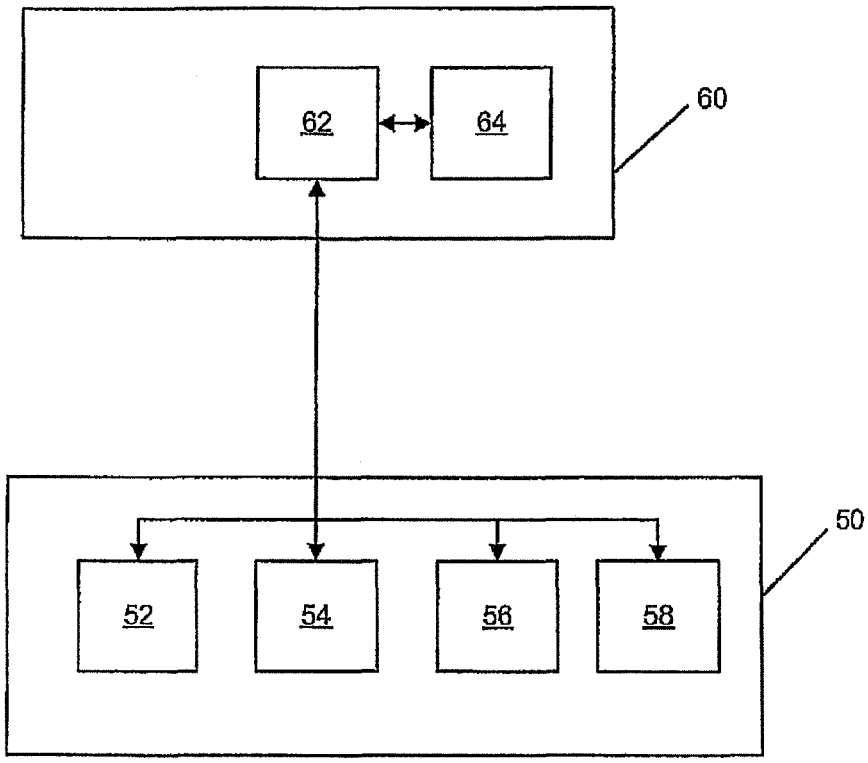
FIG. 1 is a schematic block diagram of core components of a gaming system in accordance with an embodiment of the present invention.

Irrespective of the form, the gaming system comprises several core components. At the broadest level, the core components are a player interface 50 and a game controller 60 as illustrated in FIG. 1. The player interface is arranged to enable manual interaction between a player and the gaming system and for this purpose includes the input/output components required for the player to enter instructions and play the game.

Components of the player interface may vary from embodiment to embodiment but will typically include a credit mechanism 52 to enable a player to input credits and receive payouts, one or more displays 54 and a game play mechanism 56 that enables a player to input game play instructions (e.g. to place bets), and one or more speakers 58.

The game controller 60 is in data communication with the player interface and typically includes a processor 62 that processes the game play instructions in accordance with game play rules and outputs game play outcomes to the display. Typically, the game play instructions are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server.

Figure 2:
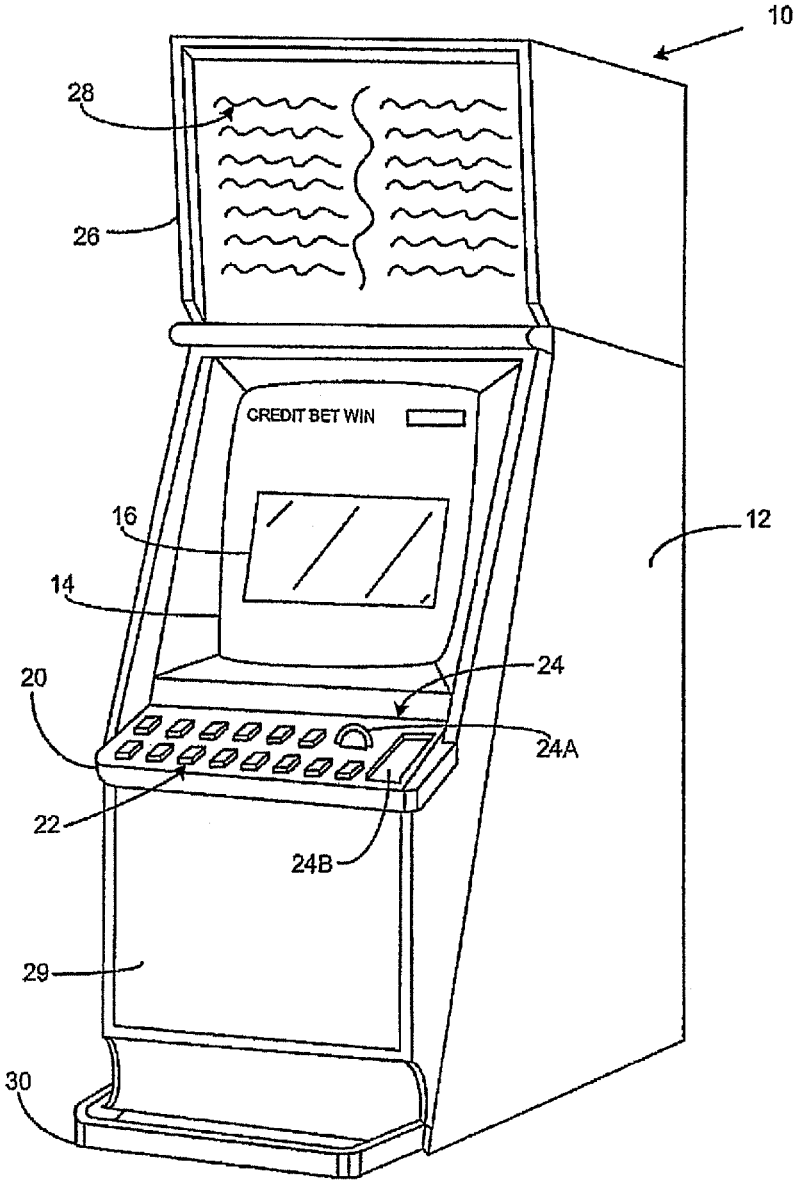
FIG. 2 is a diagrammatic representation of a gaming system in accordance with an embodiment of the present invention with the gaming system implemented in the form of a stand alone gaming machine.

A gaming system in the form of a stand alone gaming machine 10 is illustrated in FIG. 2. The gaming machine 10 includes a console 12 having a display 14 on which is displayed representations of a game 16 that can be played by a player. A mid-trim 20 of the gaming machine 10 houses a bank of buttons 22 for enabling a player to interact with the gaming machine, in particular during gameplay. The mid-trim 20 also houses a credit input mechanism 24 which in this example includes a coin input chute 24A and a bill collector 24B. Other credit input mechanisms may also be employed, for example, a card reader for reading a smart card, debit card or credit card. A player marketing module (not shown) having a reading device may also be provided for the purpose of reading a player tracking device, for example as part of a loyalty program. The player tracking device may be in the form of a card, flash drive or any other portable storage medium capable of being read by the reading device.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 2 is in the form of a video display unit, particularly a cathode ray tube screen device. Alternatively, the display 14 may be a liquid crystal display, plasma screen, any other suitable video display unit, or the visible portion of an electromechanical device. The top box 26 may also include a display, for example a video display unit, which may be of the same type as the display 14, or of a different type.

Figure 3:
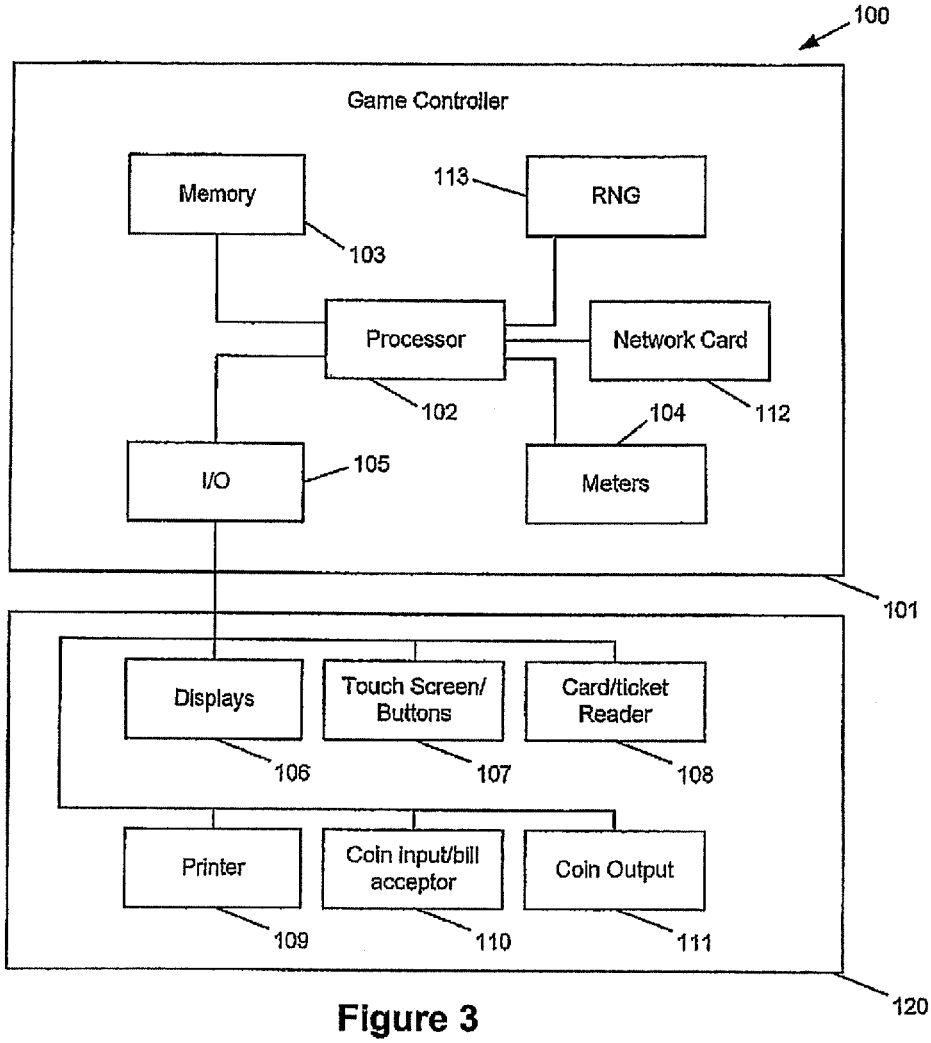
FIG. 3 is a schematic block diagram of operative components of the gaming machine shown in FIG. 2.

FIG. 3 shows a block diagram of operative components of a typical gaming machine which may be the same as or different to the gaming machine of FIG. 2.

The gaming machine 100 includes a game controller 101 having a processor 102. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 comprise one or more displays 106, a touch screen 107, a card and/or ticket reader 108, a printer 109, a bill acceptor and/or coin input and/or buttons mechanism 110 and a coin output mechanism 111. Additional hardware may be included as part of the gaming machine 100, or hardware may be omitted as required for the specific implementation. In addition, the gaming machine 100 may include a communications interface, for example a network card 112. The network card may, for example, send status information, accounting information or other information to a central controller, server or database and receive data or commands from the central controller, server or database.

Figure 4:
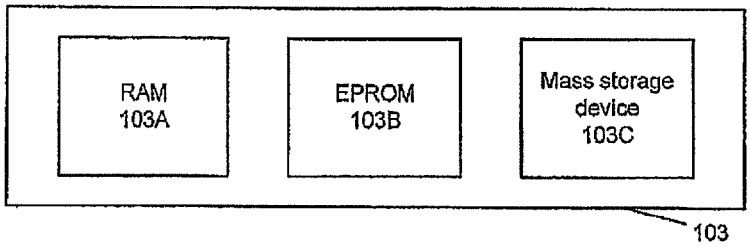
FIG. 4 is a schematic block diagram of components of a memory of the gaming machine shown in FIG. 2.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106,107,108,109,110,111 to be provided remotely from the game controller 101.

Figure 5:
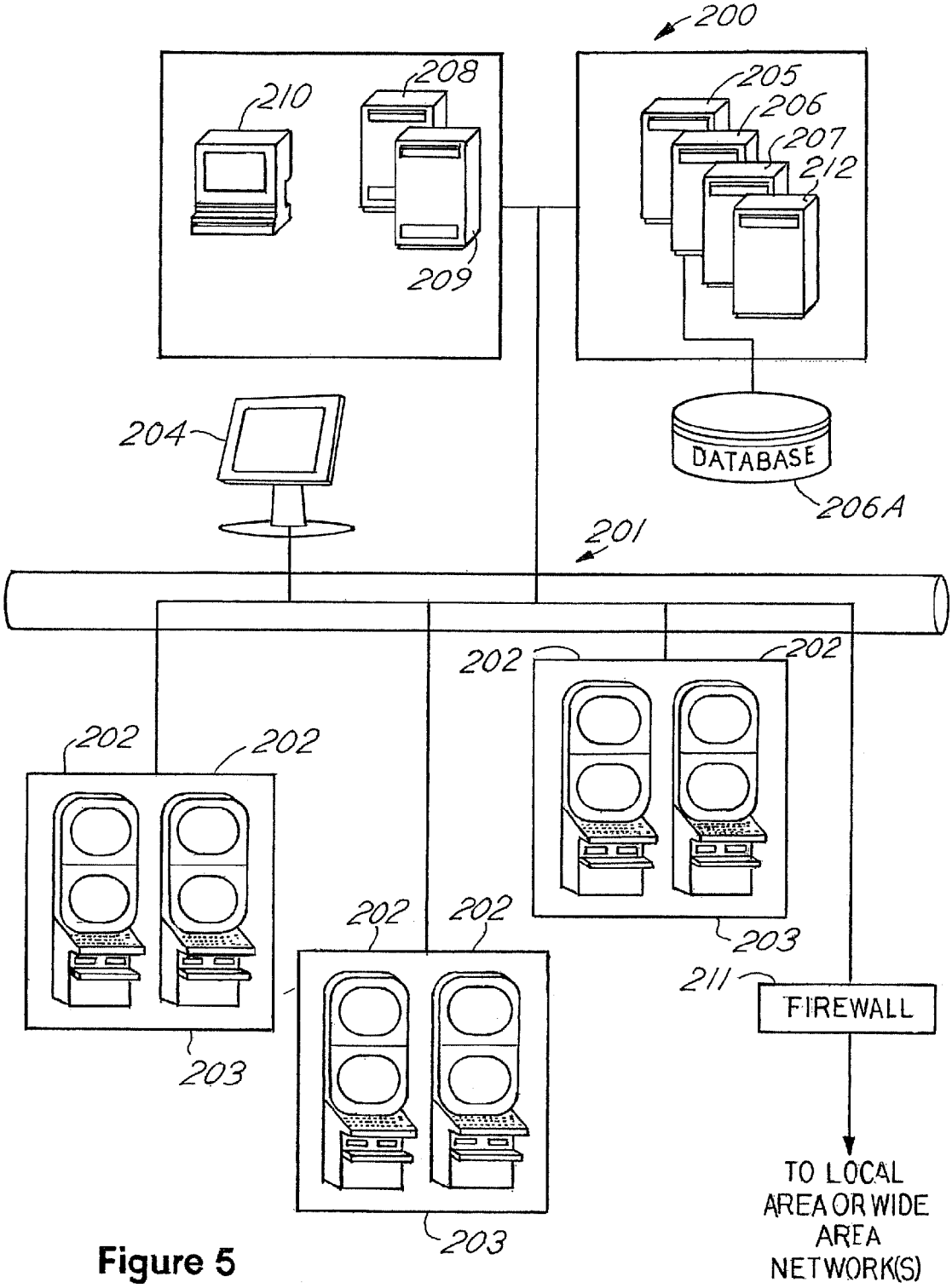
FIG. 5 is a schematic diagram of a gaming system in accordance with an alternative embodiment of the present invention with the gaming system implemented over a network.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5, are connected to the network 201. The gaming machines 202 provide a player operable interface and may be the same as the gaming machines 10,100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. The displays 204 may, for example, be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to monitor and carry out the Jackpot game. A loyalty program server 212 may also be provided.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming network 200 may communicate with other gaming systems, other local networks, for example a corporate network, and/or a wide area network such as the Internet, for example through a firewall 211.

Figure 6:
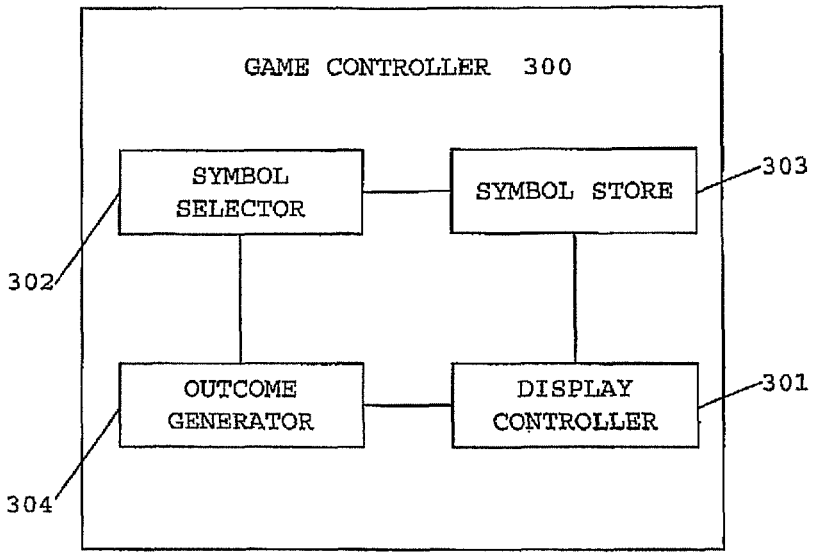
FIG. 6 is a schematic diagram of functional components of a gaming system in accordance with an embodiment of the present invention.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of games servers could be provided to run different games or a single game server may run a plurality of different games as required by the terminals. Referring to FIG. 6, the functionality of embodiments of the present invention may be implemented by a game controller having the functional components illustrated. In this embodiment, the functional components are implemented utilizing a processor and memory (such as processor 102 and memory 103 in FIG. 3, or processor 62 and memory 64 in FIG. 1, or the game server 205 in FIG. 5), and associated programming. Other implementations are envisaged. For example the functional blocks of FIG. 6 may be implemented in hardware as separate units, or a combination of hardware and software as separate units. Any practical implementation of these functional units may be employed.

In this embodiment, the game controller 300 is arranged to control the gaming system to play a game which comprises selection of a plurality of symbols from a set of symbols. The game is implemented as a "reel" game. The game controller 300 comprises a display controller 301 which is arranged to control the display (reference numerals 54, 14, 106, 204 of previous figures) to emulate a representation of reels bearing symbols. Alternatively, the display may comprise a stepper motor and physical reels bearing the symbols.

The game controller 300 includes a symbol selector 302 which is arranged to select a plurality of symbols from a set of symbols available in a symbol store 303. An outcome generator 304 is arranged to determine an outcome of the game. In this embodiment, the outcome of the game depends on the selected symbols and may include a win outcome, loss outcome, trigger outcome, a feature outcome or other outcome. Outcomes may be determined on the basis of symbols appearing in one or more horizontal lines, diagonal lines, or any other pre-determined combinations.

Figure 7:
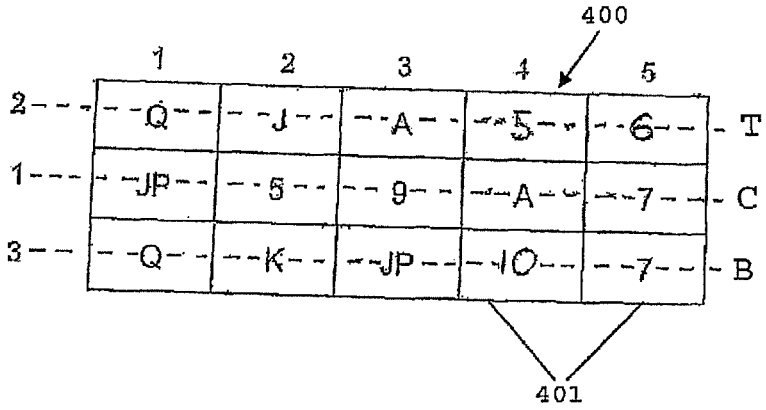
FIG. 7 is a schematic representation of an example display generated by a gaming system in accordance with an embodiment of the present invention.

FIG. 7 shows a representation of a gaming machine display 400 which, in the example shown, has five reels (numbered "1" to "5"). The display 400 shows three reel positions high when the reels have stopped/the symbols have been selected. The reel positions are designated Bottom ("B"), Centre ("C") and Top ("T"). This is a typical reel-type display for a gaming machine. It will be appreciated that in other embodiments the number of reel positions may be more or less than in display 400. Also the number of reels may be more or less than in the display 400.

The reels may be virtual reels, generated as a video display from the selected symbols, actual mechanical reels carrying the symbols and driven by a stepper motor, or any other reel arrangement or emulation. In the case of actual physical reels, the game controller drives a stepper motor to randomly select the symbols appearing in the display 400.

The game outcome is determined by the outcome generator 304 based on combinations of symbols selected and appearing in the display 400. The symbols may be any symbols. As will be appreciated, many different types of symbols are used in gaming systems. A set of symbols may include standard symbols and function symbols. For example, standard symbols may resemble fruit such as apples, pears and bananas with a win outcome being determined when a predetermined number of the same fruit appear on a display in the same line, scattered, and so on. The function associated with a function symbol may be a "wild" function wherein display of the function symbol is treated during consideration of the game outcome as any of the standard symbols. Other functions may include scatter functions, multiplier functions, repeat win functions, jackpot functions and feature commencement functions.

In the example shown in FIG. 7, the symbols are representations of cards, by which a poker-type card game may be played. In this example, a winning poker hand appearing on the C line may cause the outcome generator to determine that a Win has occurred and that an appropriate prize may be awarded. For example, five of a kind (e.g. 5 jacks "J". 5 tens "10" etc) on the C line may result in a win. A straight or a straight flush or any other poker combination on the C line may also result in a win. "JP" are also shown representing jackpot symbols.

The diagram shown in FIG. 7 is one way of representing the symbols only. It will be appreciated that in other embodiments of the invention symbols may be represented in different ways, using any type of fancy artwork, or in any appropriate manner.

Operation of embodiments of the present invention will now be described with reference to FIGS. 7 to 28.

Referring to FIG. 7, the symbol selector 302 selects a plurality of symbols from symbols available from the symbol store 303. The game controller 300 operates via the display controller 301 to emulate spinning of reels in the display 400. The selected symbols 401 are "spun up" on the reels. This is how a conventional video animated reel spin game operates. A game outcome is determined by the outcome generator 304 depending upon line or scatter combinations (or other features, such as bonus awards) of the symbols appearing in the display 400.

A player may bet credit on one or more "win lines". Referring to FIG. 7, typically there are at least three win lines in a conventional slot machine. Examples are illustrated by ghost lines through the top T, centre C and bottom B rows. These give win lines 1 (C), 2(T) and 3(B). A player may bet credit on one or more lines. If a winning symbol combination appears on a win line that a player has bet credit on, then they win the appropriate multiple of their credit as a prize. If they don't bet any credit on a win line, and any winning combination comes up on that line, then the player will generally receive no return. There may be many other win lines in gaming systems, some gaming systems provide up to 100 win lines that a player can bet credit on. In order to maintain player interest, it is desirable to be able to offer different ways of winning more prizes, and more variety of games. In this embodiment of the present invention, the gaming system is arranged so that a player may play for a "feature" which includes the player being able to obtain non-standard win patterns, in this embodiment being of a non-linear pattern. These are not win patterns in a base or "standard" game (although an alternative embodiment does allow them to be win patterns in a base game—see later) but must be awarded to the player as a feature in response to a trigger condition being satisfied. This gives an extra "level" of game play, which is advantageously entertaining and maintains player interest.

FIGS. 8 to 14 illustrate various feature patterns in accordance with this embodiment of this invention, termed "stair combinations". If a player obtains a feature game (by satisfying a pre-determined trigger condition) then he may play for a prize which may be paid when one or more of the designated stair combinations is achieved. Which of stair combinations are designated is determined by the game designer. FIG. 8 illustrates a "stair down corner to corner" pattern which may be a winning combination, of "10" symbols. The stair down corner to corner pattern is referenced by numeral 405. Reading from left to right of the column/row arrangement of symbol positions, the first symbol of the pattern starts in the top left hand corner, steps down from columns 2 to column 3 in the bottom row B and two further "10" symbols are also in the bottom row. It can be seen that there are two "steps" in this stair down corner to corner pattern. The steps are between columns 1 and 2 and 2 and 3, the stair down corner to corner pattern 405 extends from the left most column (column 1) all the way to the right most column (column 5).

Figure 9:
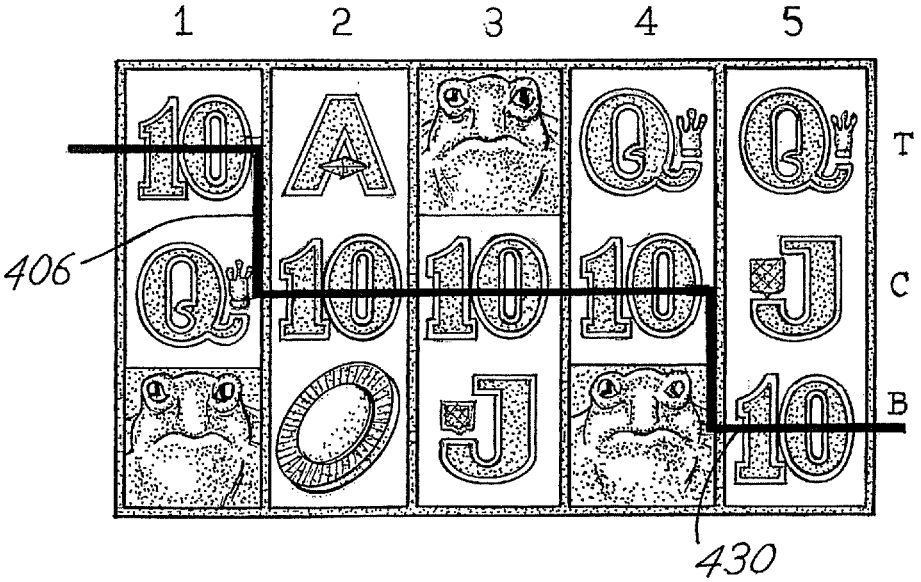

FIG. 9 illustrates a further stair-down corner to corner combination of "10" symbols, but this time three of the "10" symbols lie on the C row (columns 2, 3, 4). This pattern is referenced by reference numeral 406. In this pattern there are also two steps, the first step being between columns 1 and 2 and the second step being between columns 4 and 5.

Figure 10:
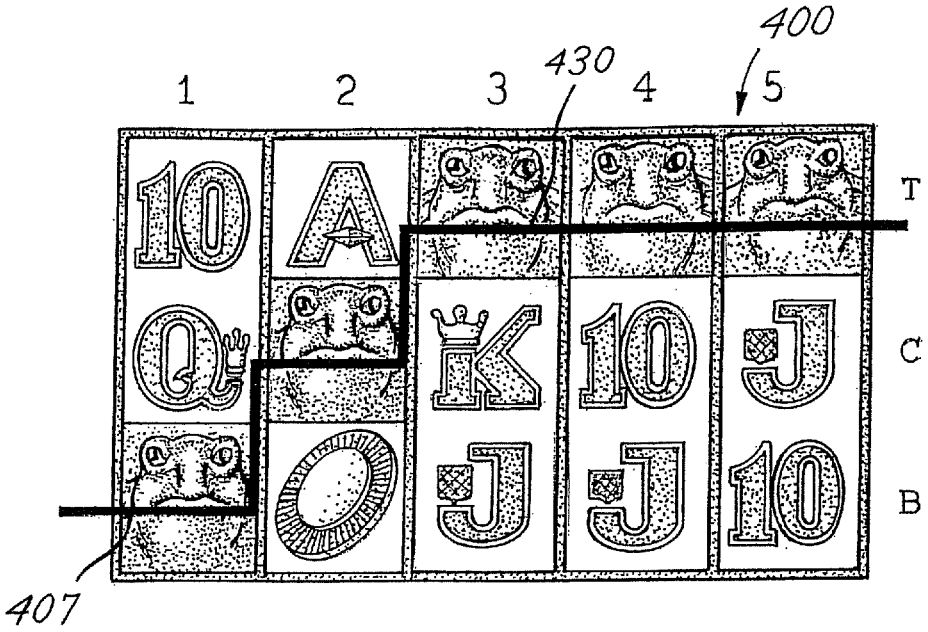

FIG. 10 illustrates a "stair-up corner to corner" pattern 407 where the Turtle ("Tu") symbol extends from B1, steps up to T3 and finishes at T5.

Figure 11:
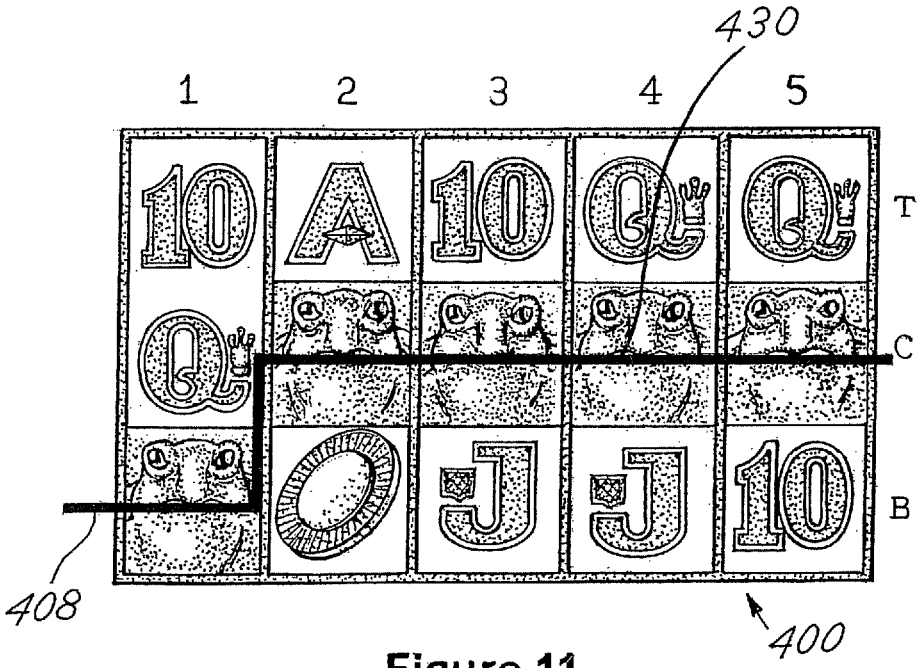

FIG. 11 illustrates a "stair-left-right" combination of Tu symbols, referenced by reference numeral 408. In this example the pattern does not extend from corner to corner of the row/column array. There is still, however, a step in the pattern between columns 1 and 2. The stair combination does extend from the left most column 1 to the right most column 5.

Figure 12:
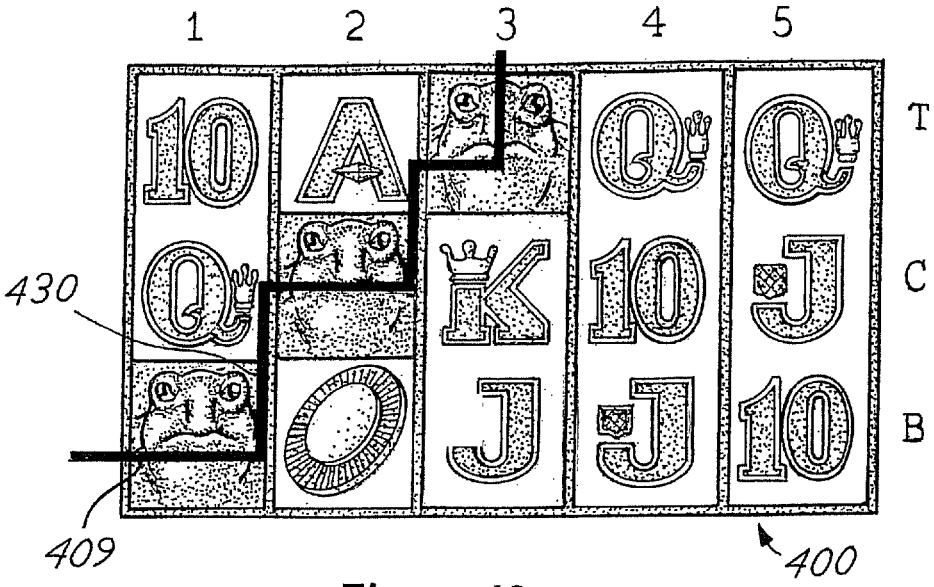

FIG. 12 shows a stair-up pattern 409 which extends from B1 to T3. This pattern does not extend from left to right of the column/row array, ending at column 3. It does include steps between columns 1 and 2 and columns 2 and 3, respectively.

Figure 13:
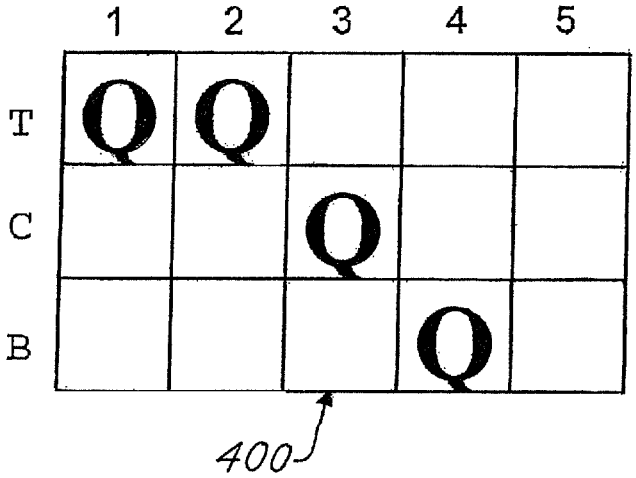
FIGS. 13 and 14 are schematic representations of example displays generated by a gaming system in accordance with an embodiment of the present invention, illustrating further feature patterns.

FIG. 13 shows a stair-down pattern which starts at T1, and ends at B4.

Figure 14:
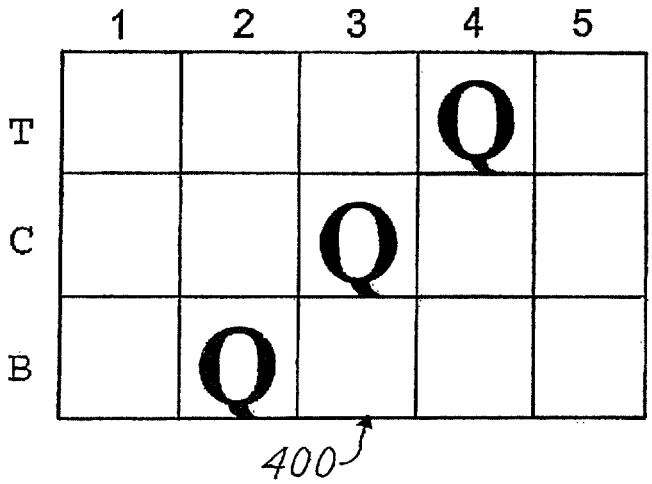

FIG. 14 illustrates a further stair-up pattern, starting at B2 and ending at B4.

It can be seen that some of the patterns do not extend all the way across the reel display.

It will be appreciated that other stair patterns (patterns including steps between the symbols) may be applied than only those illustrated in the drawings.

The combination of symbols may be any combination of symbols. In the above embodiments, it is shown as being a pattern of the same symbol combination. Different symbols could form a combination, however. For example, in poker the hand Ace, King, Queen, Jack, Ten, may form a winning combination. Any arrangement or combination of symbols may be utilized, as determined by the game designer.

In this embodiment, a chance to win a prize based on a stair feature is dependent on a trigger condition. The stair feature is therefore an extra feature in addition to play of a base game (which may, in this embodiment, have traditional win lines that a player may bet credit on). Triggers for the feature may include the amount of credit bet by a player, a particular combination of symbols or scatter of symbols being spun up in the base game, a particular amount of waiting activity, player tracking information, a random event, or any other trigger. It may be based on a combination of these criteria.

Once the trigger condition is satisfied, the player is able to play a game for a stair feature. This may be termed, for example, a "win on the stairs" feature, for player entertainment.

Example 1

In one example of how this embodiment may be implemented, any prize on the stair may pay double the usual prize regardless of whether the player has purchased the lines e.g. the player buys 5 lines in a base game. The stair feature is triggered. In this example, the stair feature triggers a series of free games (e.g. 5) during which the reels will be spun and during which wins will be paid on one or more stair features (which stair features are paid depends upon game designer choice). Any prize on a stair will pay double the usual prize regardless of whether the player has purchased the lines. The second free game provides 5 Kings in a stair combination. The player wins the prize for five Kings which for example equals 100×2 (doubling the prize) equals 200 credits. In another game, the player may buy a hundred lines in the standard game, and then the feature is triggered. Again the feature is 5 free games and the second game has five Kings on a stair pattern which is also on a purchased line. The player is paid for the purchased line which equals 100 credits and also paid for the stair prize which equals 2×100, so a total prize of 300 credits.

In the above example, it can be seen how a player can obtain additional prizes when the gaming system utilizes the stair feature.

Example 2

In this example, during a series of feature games, prizes are only paid if a symbol combination is in a stair layout. In the main game, the player pays credit on 100 lines, and the feature of 5 free games is triggered. In the first game, there are no symbols in a stair layout. Second game 3 Aces in a stair layout (50 credits won). Third game, no symbols in a stair layout. Fourth game, 3 Queens in a stair layout and 3 Jacks in a stair layout (wins 40 credits with the Queens and 30 credits for the Jacks). In the fifth game, 4 Kings in a stair layout, win 250 credits.

Figures 15, 16:
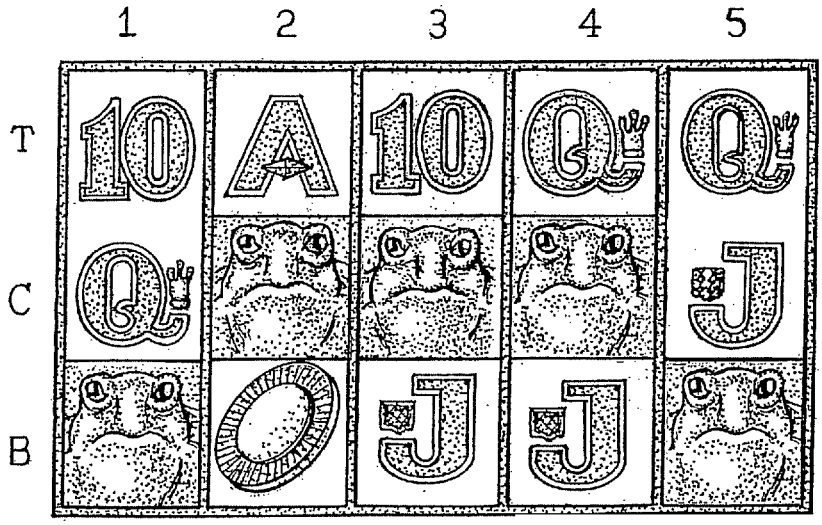
FIGS. 15 is a schematic representation of example displays generated by a gaming system in accordance with an embodiment of the present invention, illustrating an adjustment in position of the symbols in a feature pattern.
FIG. 16 is an example display generated by a gaming system in accordance with an embodiment of the present invention, showing a further feature pattern.

In a variation on this embodiment, the game controller is arranged to adjust the position in the pattern of at least one of the symbols in the pattern, in order to vary the pattern. In one embodiment, a stair pattern may be adjusted to a line pattern, for example. Such an example is illustrated in FIG. 15. FIG. 15 shows that a stair-down pattern has been spun up on the reels (in this example four "Q" symbols). In this example game, the stair-down pattern may not be the winning combination per se. Instead, a reel nudge is performed as indicated by arrows 410 to bring all four Q symbols onto the top line T. This is now a winning line combination.

In one embodiment, the game controller 300 is arranged to perform the reel nudge automatically. In an alternative embodiment, a player may be required to operate a player interface to actuate the nudge. This may require some minimal amount of skill on the part of the player (to make sure they nudge the reels to get the proper line combinations), which may increase entertainment.

Figure 17:
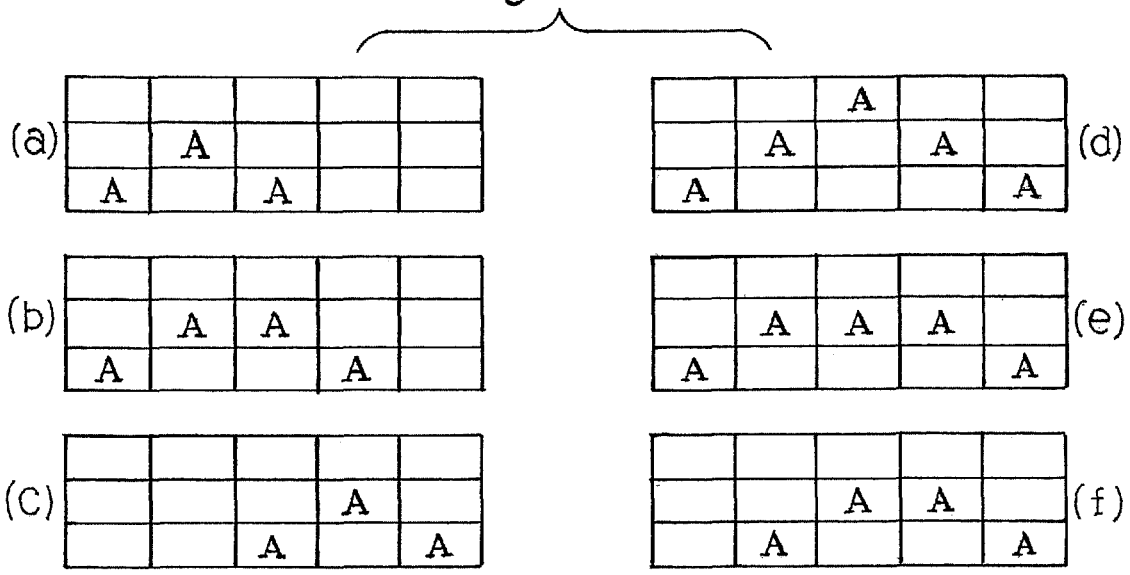
FIGS. 17 and 18 are schematic representations of example displays generated by a gaming system in accordance with an embodiment of the present invention, illustrating further feature patterns.
Figure 18:
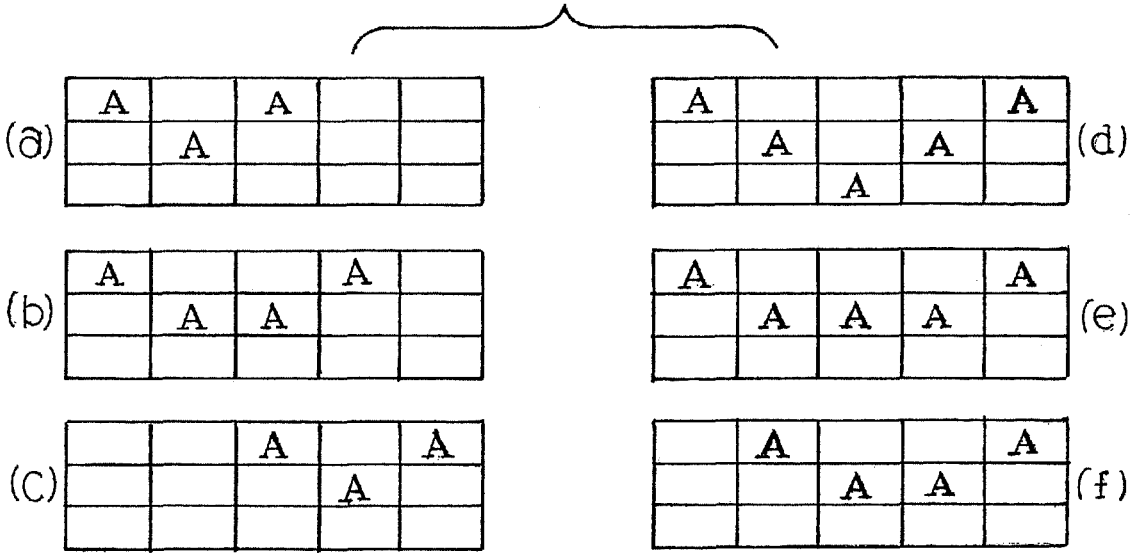

FIGS. 16 to 18 illustrate a further non-linear pattern that may be generated by a gaming system in accordance with an embodiment of the present invention. This type of pattern is termed a "pyramid combination". In this embodiment, in a pyramid combination the "base" of the pyramid comprises at least two symbols which are positioned on the bottom line B (normal pyramid) or top line T (inverted pyramid). The top of the pyramid is then formed by other symbols in positions joining with the base symbols.

FIG. 16 shows a "flattened" pyramid 450 including five Turtle symbols. The base symbols of the pyramid are at positions B1 and B5. The top of the pyramid is formed by three symbols in the C row, columns 2, 3 and 4.

Referring to FIG. 17*d*, a pyramid with a peak is shown. The pyramid is formed by five A symbols, one of them being in T3 position, two of the symbols being in C2 and C4 respectively and the base symbols being at B1 and B5 respectively.

FIG. 17*a* shows a pyramid which comprises only three symbols, the base symbols being at B1 and B3 and the top symbol being at C2. FIGS. 17*b*, 17*c*, 17*e* and 17*f* show different variations of pyramids and flattened pyramids (FIG. 17*e* is the same flattened pyramid pattern as FIG. 16). It will be appreciated that other pyramid patterns than shown here may be formed.

FIG. 18 shows examples of inverted pyramid patterns. FIG. 18*d* shows a full inverted pyramid from left to right of the reels (across all the reels), comprising five A symbols. The base A symbols are at T1 and T5 respectively.

FIG. 18*e* shows an inverted flattened pyramid with the base symbols at T1 and T5 and the top of the pyramid being three A symbols at C2, C3 and C4.

It will be appreciated that other variations of inverted pyramids may be created in addition to those illustrated in FIG. 18.

As with the stair feature discussed above, the gaming system may require a further adjustment to the pyramid structure to create a straight win line before awarding a prize, in one variation. In other variations prizes may be awarded on the basis of the occurrence of the pyramid patterns per se.

Figure 19:
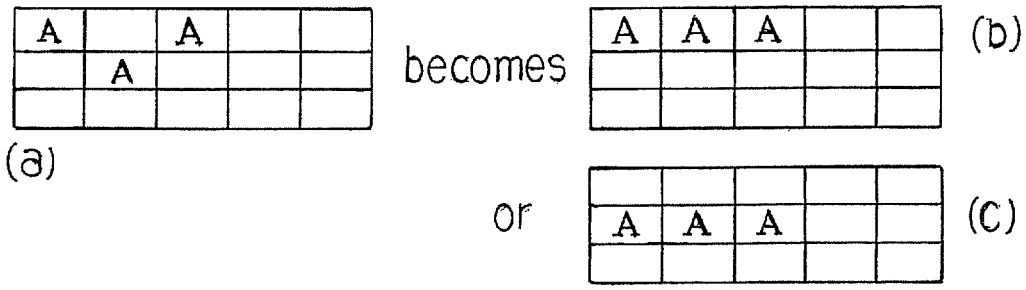
FIGS. 19 to 21 are schematic representations of example displays generated by a gaming system in accordance with an embodiment of the present invention, illustrating the adjustment of position of symbols arranged in feature patterns.
Figure 20:
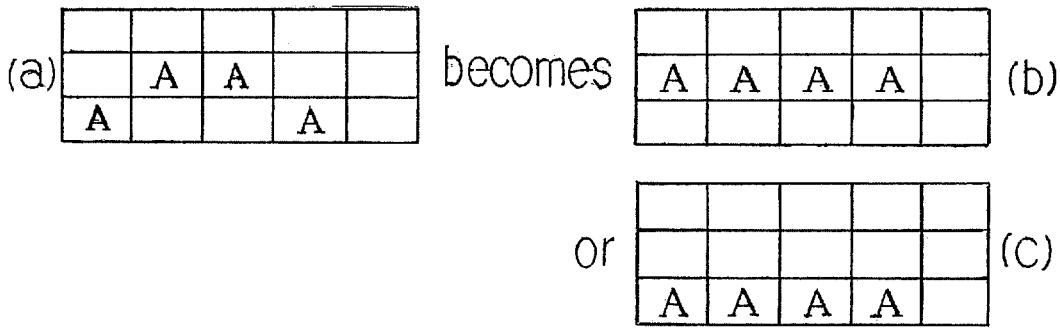
Figure 21:
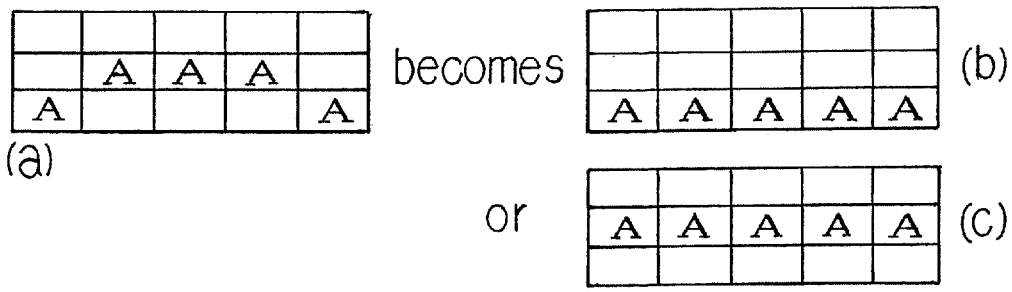

FIGS. 19 to 21 show pyramid patterns where subsequent adjustments in the form of reel nudges are carried out to create straight win lines.

FIG. 19*a* shows an inverted pyramid comprising three A symbols. A nudge of the middle A symbol from C2 to B2 results in a straight line on the T2 line of three A symbols (FIG. 19*b*). Alternatively, a nudge of two A symbols in T1 and T3, respectively, results in a straight win line on the centre line C (FIG. 19*c*).

Referring to FIG. 20, FIG. 20*a* shows a flattened pyramid in rows 1 to 4, with the base symbols being at B1 and B4 and the top symbols being at C2 and C3. Again, two nudges are available if the feature is to be adjusted to a straight win line. Nudging the base symbols upwards results in a straight win line on the C line, as illustrated in FIG. 20*b*. Alternatively, nudging the two top symbols on the C line downwards to the bottom line B, results in a straight win line on the B line as shown in FIG. 20*c*. Providing alternative possibilities for nudging the symbols may result in increased player entertainment, particularly if a player has, for example, varied his bet on each of the pay lines (i.e. bet more on one pay line than the other). As discussed above, the player may also be required to operate a player interface in order to actuate the nudge, further increasing the entertainment value. Alternatively, the gaming system may operate the reel nudge.

Referring to FIG. 21, this shows a flattened pyramid across reels 1 to 5, with the base symbols at B1 and B5 respectively and the other symbols being in the 2, 3 and 4 rows on the C line. Again, two nudges are available to form a straight win line. Either the base symbols are nudged upwards (FIG. 21*c*), or the top symbols are nudged downwards (FIG. 21*b*).

Figure 22:
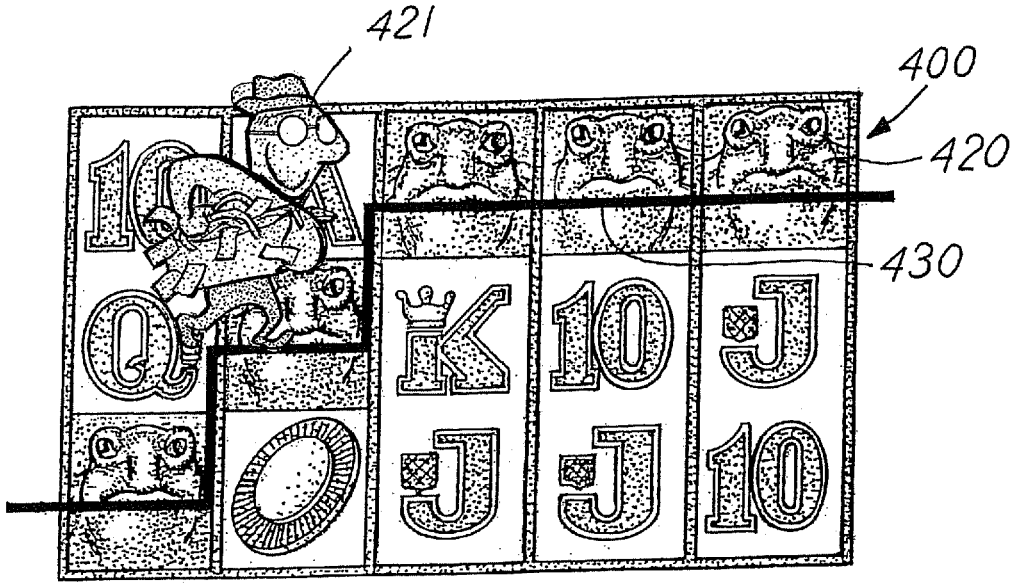
FIG. 22 is an example display generated by a gaming system in accordance with an embodiment of the present invention, illustrating a further feature.

Another feature that may be implemented by a gaming system in accordance with an embodiment of the present invention is generation by the game controller 300 of a character which may move along the non-linear pattern. FIG. 22 shows a reel display 400 which has spun up a stair up corner to corner pattern of Turtles 420. A graphical character in the form of a cartoon figure 421 is represented running up the stair pattern formed by the pattern of symbols 420. In so doing, the display 400 may represent the character 421 as spilling money, and credits are awarded to the player for this win. This provides an entertaining and interesting graphical display to maintain the interest of the player.

It will be appreciated that other types of graphical characters may be used in variations on this theme, to increase player interest. The graphical character may be any character e.g. a representation of an animal, a human being, a cartoon character or any other character or item.

In an embodiment of the invention, a line may be displayed on the display 400 in order to clearly identify the non-linear pattern. One such line 430 is shown in FIG. 12 and it can be seen it clearly identifies the step shape in the step pattern 420. Similar lines marking out non-linear patterns are also shown in FIGS. 8, 9, 10, 11 and 12.

The following example is of a game variation which utilizes a reel nudge feature.

Example 3

The game relates to a conventional 5×3 visible reel display paying only three lines, top line T, centre line C and bottom line B. This type of game is very common. The prizes are defined as only being awarded on a pay line and the player must purchase the pay line. To play the base game, therefore, the player merely purchases the pay lines (betting credit against the pay lines the player wishes to back). In order to trigger the feature, the player may also place an ante-bet (further credit bet) to purchase reel nudges if pyramid patterns are spun up. In this example, the player bets $1 per pay line and $1 for the ante-bet, giving a total bet of $4. The player spins the reels and five Aces appear in a pyramid pattern. The machine automatically nudges the five Aces onto the centre line and the player wins the prize on the centre line of the 5 Aces. If the player hadn't purchased the ante-bet for the pyramid feature before this, they would not have won.

It will be appreciated that there are many other variations than the three examples given above of games that may be played utilizing pyramid and/or stair features, with or without reel nudges, with or without graphical characters appearing.

The non-linear patterns used with embodiments of the present invention are not limited to pyramid or stair patterns. Other non-linear patterns may be used.

In an embodiment, a plurality of symbols in a single column may be used within a non-linear pattern. This embodiment may be particularly useful for reel games where there are stacked symbols within the reels (i.e. two or more symbols of the same type within a single reel).

Referring to FIG. 25, a display of an embodiment of the invention is shown, which utilizes stacked symbols and reels 1 and 4 and 2 and 3 to form a rectangular non-linear pattern (the A symbols).

FIG. 26 shows a rhombus.

FIG. 27 shows a hexagon.

FIG. 28 shows a triangle of symbols, also utilizing stacked symbols.

It will be appreciated that other patterns may be made, utilizing stacked symbols, or not utilizing stacked symbols.

In the above embodiments, the symbols are shown as being the same symbols. They may not be, the pattern may be made up of different symbols, according to game rules.

Figure 23:
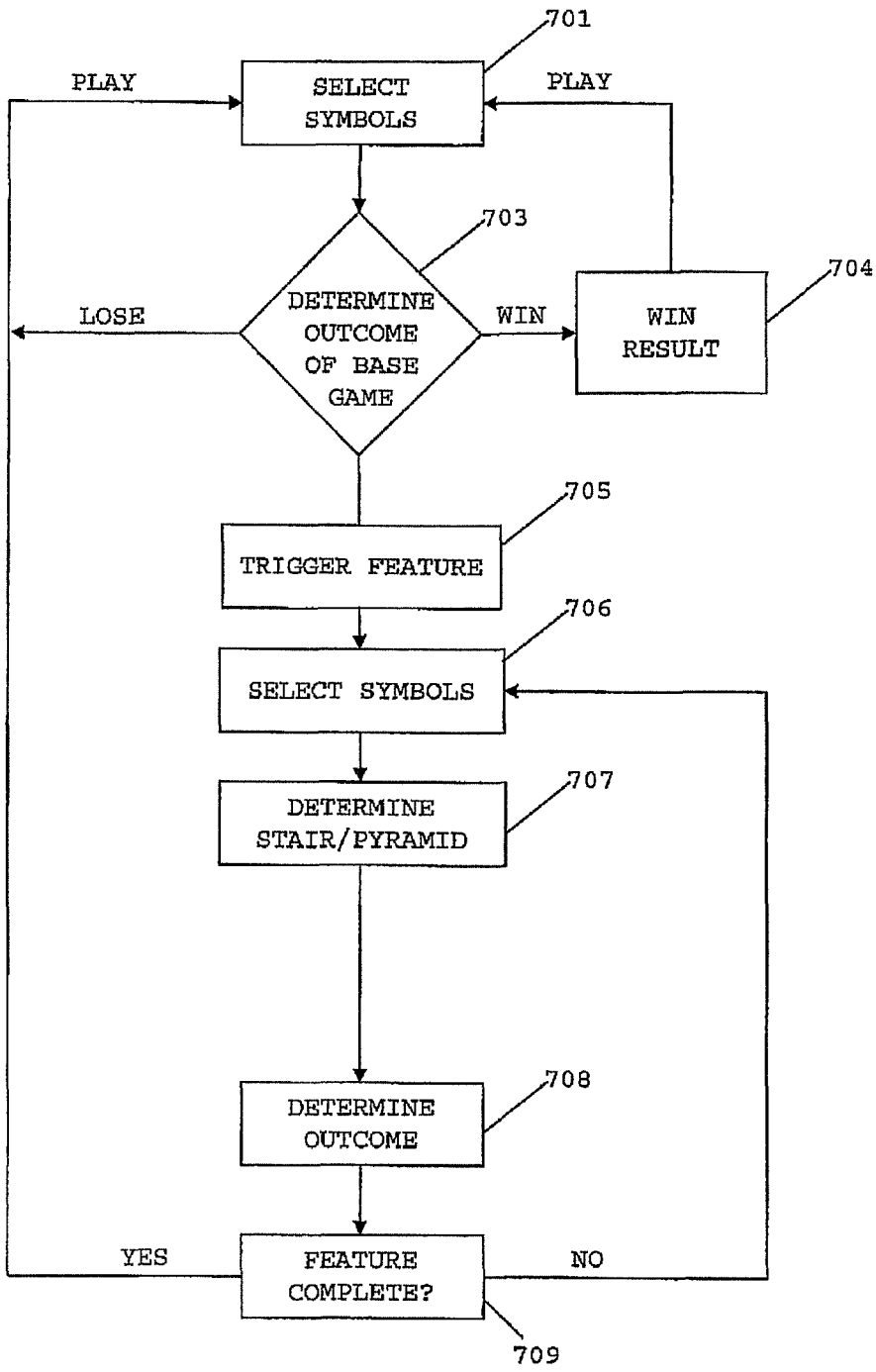
FIGS. 23 and 24 are flow diagrams illustrating operation of a gaming system in accordance with embodiments of the present invention.

A game playing process in accordance with one embodiment of the present invention will now be summarized with reference to FIG. 23. FIG. 23 relates to an embodiment of a gaming system where a base game is played, for example, utilizing conventional line combinations of symbols, and a feature game may be triggered wherein at least one game outcome is a stair and/or pyramid combination during play of a series of feature games.

At step 701 the base game is played and the symbol selector 302 selects the symbols for play of the base game and the symbols are displayed. At step 703 an outcome of the base game is determined. This may be a win outcome, in which the case a win result 704 is generated and the requisite prize is awarded. The win result may be based on conventional combinations of symbols in conventional pay line patterns. The system then returns to step 701 for the player to choose whether or not to play the game again.

If at step 703 the outcome is a lose outcome, the player may again decide whether to play the game again.

In this embodiment, there is a further outcome of the base game, which is triggering of the feature game. As discussed above, the feature game may be triggered by any trigger, including combinations of symbols spun up in the base game. If the outcome is a trigger feature, at step 705 the trigger feature is generated.

In this embodiment, the trigger feature results in play of five free feature games (note that there may be any number of feature games and the invention is not limited to just five). Each feature game can be played for a win of a prize depending upon a stair and/or pyramid outcome being spun up. This is similar to Example 1 discussed above.

At step 706 the symbols are selected for the feature game. At step 707 it is determined whether a stair or pyramid feature that may win has been spun up and at step 708 the outcome is determined. This may include a win because of a stair or pyramid feature being spun up. At step 709 it is determined whether the feature is complete (i.e. have all free games been played?). If NO, a further feature game is played. If YES then the player has the choice whether or not to play the base game again.

Figure 24:
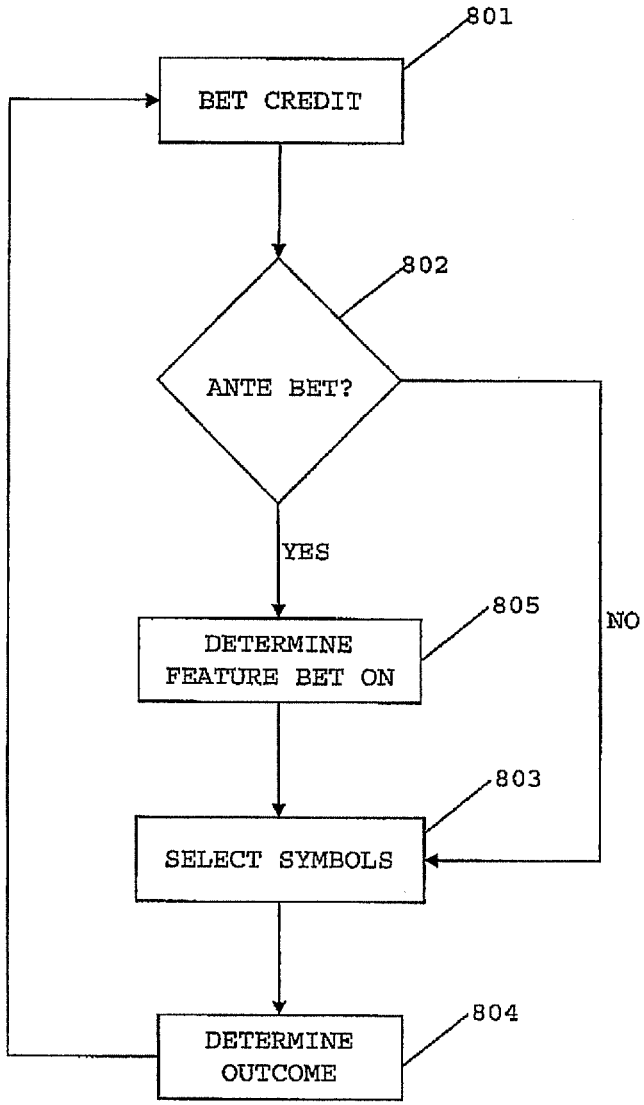

Referring to FIG. 24, the process of playing a game which an ante-bet is required in order to trigger a stair and/or pyramid feature, will now be described.

At step 801, the player bets credit on a base game and also has the opportunity to make an ante-bet for a stair/pyramid feature. At step 802, the game controller 300 determines whether an ante-bet has been made. If NO, at step 803 the symbol selector 302 selects the symbols for the base game as normal and at step 804 the game outcome is determined.

If at step 802 it is determined that an ante-bet has been made, at step 805 a determination is made as to which feature the player has made the ante-bet for. For example, depending upon the game design, the player may be offered a number of different non-linear patterns to bet against e.g. a number of stair features and a number of pyramid features. At step 805, the game controller determines which features have been bet against and therefore which features will win a prize. In an alternative embodiment, only one feature may be available for a prize (e.g. one particular stair or pyramid feature) and therefore no determination need be made at step 805.

Following any determination at step 805, the symbols are selected at 803 and the outcome determination at 804 takes into account any non-linear pattern outcome authorized by the ante-bet 802.

In the above embodiments, the non-linear pattern is played as a feature game. The invention is not limited to this. In alternative embodiments, non-linear patterns such as pyramids and/or stair combinations or any other non-linear pattern, may form part of a base game, not a separate feature. For example, a pyramid combination or stair combination may be a win line against which a player can bet credit in a base game.

The above embodiments give a number of examples of games and a number of examples of gaming processes (particularly in relation to FIGS. 23 and 24). The game processes and game examples are not limited to those described. It will be appreciated that there may be many variations in which a stair and/or pyramid combination or other non-linear patterns may be utilized to provide additional entertainment to a player.

In the above described embodiments, the display emulates a plurality of reels. In an alternative embodiment, the symbol selection may be implemented as actual reels driven by a stepper motor. Any additional graphics, such as a graphical character moving along the non-linear pattern, may be provided as a video overlay to the actual stepper display, or provided in another way. In another embodiment, the display may not emulate reels but merely show the selected symbols in a non-reel format e.g. presenting them as emulated playing cards, or other representations in the series of rows and columns.

It will be appreciated that the above described embodiments may be implemented by utilizing program code. The program code may be supplied in a number of ways, for example on a computer readable medium, such as a disk or a memory, or as a data signal (for example, by downloading it from the server).

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A gaming system, comprising a game controller arranged to control play of a base game and a feature game, and a display arranged to display a representation of play of the base game and the feature game, the game controller being arranged to:

select a plurality of symbols from a set of symbols for play of the base game;

control the display to display the selected plurality of symbols in fixed rows and columns;

determine an outcome of the base game based on the selected plurality of symbols in the rows and columns, wherein a winning outcome of the base game is determined in response to the selected plurality of symbols forming a predefined winning pattern of symbols that spans across all columns of the display and that aligns with a win line from a plurality of activated win lines of the base game;

generate a feature game after the base game in response to a trigger condition; and determine an outcome of the feature game depending on whether a non-linear pattern of symbols displayed in the fixed rows and columns of the display during the feature game is a winning pattern of symbols that is distinguishable from the plurality of activated win lines of the base game, wherein the non-linear pattern comprises two or more symbols within a column.

2. A gaming system in accordance with claim 1, wherein the non-linear pattern comprises a stair combination.

3. A gaming system in accordance with claim 2, wherein the stair combination comprises a stair-down combination.

4. A gaming system in accordance with claim 2, wherein the stair combination comprises a stair-up combination.

5. A gaming system in accordance with claim 1, wherein the non-linear pattern comprises a pyramid combination.

6. A gaming system in accordance with claim 5, wherein the pyramid combination comprises a normal pyramid pattern.

7. A gaming system in accordance with claim 5, wherein the pyramid combination comprises an inverted pyramid pattern.

8. A gaming system in accordance with claim 5, wherein the pyramid combination is a flattened pyramid pattern.

9. A gaming system in accordance with claim 1, wherein the game is a reel game including reels with stacked symbols, and the two or more symbols are stacked symbols on a reel.

10. A gaming system in accordance with claim 1, wherein the non-linear pattern is a rectangle.

11. A gaming system in accordance with claim 1, wherein the non-linear pattern is a rhombus.

12. A gaming system in accordance with claim 1, wherein the non-linear pattern is a hexagon.

13. A gaming system in accordance with claim 1, wherein the non-linear pattern is a triangle.

14. A gaming system in accordance with claim 1, wherein the game controller is arranged to adjust the position of at least one of the symbols in a non-linear pattern outcome to result in a line pattern.

15. A gaming system in accordance with claim 1 wherein the game controller is arranged to control the display to display a graphical character moving over the non-linear pattern of symbols.

16. A gaming system in accordance with claim 1, wherein the trigger condition is that a player must make an ante-bet of credit.

17. A gaming system in accordance with claim 1, wherein the game controller and display are implemented as a stand alone gaming machine.

18. A gaming system in accordance with claim 1, wherein the game controller and display are implemented by a gaming server and gaming client architecture.

19. A computer program comprising instructions for controlling a computer to implement a gaming system in accordance with claim 1.

20. A computer readable medium providing a computer program in accordance with claim 19.

21. A data signal comprising a computer program in accordance with claim 19.

22. A gaming system in accordance with claim 1, wherein the non-linear pattern does not extend across all the columns of the display.

23. A method of gaming, comprising:

selecting a plurality of symbols from a set of symbols for play of a base game;

displaying the selected plurality of the symbols in fixed rows and columns of a display;

determining an outcome of the base game based on the selected plurality of symbols in the rows and columns, wherein a winning outcome of the base game is determined in response to the selected plurality of symbols forming a predefined winning pattern of symbols that spans across all columns and that aligns with a win line from a plurality of predetermined win lines of the base game;

playing a feature game after the base game in response to a pre-determined trigger condition being satisfied; and determining an outcome of the feature game depending on whether a non-linear pattern of symbols in the fixed rows and columns of the display during the feature game is a non-linear winning pattern of symbols that is distinguishable from the plurality of predetermined win lines of the base game, wherein the non-linear pattern includes a plurality of symbols in one column.

24. A method in accordance with claim 23, wherein the non-linear pattern comprises a stair combination.

25. A method in accordance with claim 24, wherein the stair combination comprises a stair-down combination.

26. A method in accordance with claim 24, wherein the stair combination comprises a stair-up combination.

27. A method in accordance with claim 23, wherein the non-linear pattern comprises a pyramid combination.

28. A method in accordance with claim 27, wherein the pyramid combination comprises a normal pyramid pattern.

29. A method in accordance with claim 27, wherein the pyramid combination comprises an inverted pyramid pattern.

30. A method of gaming in accordance with claim 27, wherein the pyramid combination is a flattened pyramid pattern.

31. A method in accordance with claim 23, wherein the game is a reel game, and the plurality of symbols are stacked symbols within a reel.

32. A method in accordance with claim 23, wherein the non-linear pattern is a rectangle.

33. A method in accordance with claim 23, wherein the non-linear pattern is a rhombus.

34. A method in accordance with claim 23, wherein the non-linear pattern is a hexagon.

35. A method in accordance with claim 23, wherein the non-linear pattern is a triangle.

36. A method in accordance with claim 23, further comprising adjusting the non-linear pattern to result in a line pattern.

37. A method in accordance with claim 23, further comprising displaying graphical character moving over the non-linear pattern of symbols.

38. A method in accordance with claim 23, wherein the pre-determined trigger condition is placement of an ante-bet specifying a particular non-linear pattern, by a player.

39. A method of gaming in accordance with claim 23, wherein the non-linear pattern does not extend across all the columns of the display.

40. A game controller for a gaming system comprising a display, the game controller comprising a processor arranged to:

select a plurality of symbols from a set of symbols for play of a base game;

control the display to display the selected plurality of symbols in fixed rows and columns;

determine an outcome of the base game based on the selected plurality of symbols in the rows and columns, wherein a winning outcome of the base game is determined in response to the selected plurality of symbols forming a predefined winning pattern of symbols that spans across all columns and that aligns with a win line from a plurality of activated win lines of the base game;

generate a feature game after the base game in response to a trigger condition; and determine an outcome of the feature game depending on whether a non-linear pattern of symbols in the fixed rows and columns the display during the feature game is a winning pattern of symbols that is distinguishable from the plurality of activated win lines of the base game, wherein the non-linear pattern comprises two or more symbols within a column.

41. A game controller in accordance with claim 40, wherein the non-linear pattern comprises a stair combination.

42. A game controller in accordance with claim 41, wherein the stair combination comprises a stair-up combination.

43. A game controller in accordance with claim 41, wherein the stair combination comprises a stair-down combination.

44. A game controller in accordance with claim 40, wherein the non-linear pattern comprises a pyramid combination.

45. A game controller in accordance with claim 44, wherein the pyramid combination comprises a normal pyramid pattern.

46. A game controller in accordance with claim 44, wherein the pyramid combination comprises an inverted pyramid pattern.

47. A game controller in accordance with claim 44, wherein the pyramid combination is a flattened pyramid pattern.

48. A game controller in accordance with claim 40, wherein the game is a reel game, and the two or more symbols are stacked symbols on a reel.

49. A game controller in accordance with claim 40, wherein the non-linear pattern is a rectangle.

50. A game controller in accordance with claim 40, wherein the non-linear pattern is a rhombus.

51. A game controller in accordance with claim 40, wherein the non-linear pattern is a hexagon.

52. A game controller in accordance with claim 40, wherein the non-linear pattern is a triangle.

53. A game controller in accordance with claim 40, arranged to adjust the position of at least one of the symbols in a non-linear pattern outcome to result in a line pattern.

54. A game controller in accordance with claim 40, arranged to control the display of a graphical character moving over the non-hyphen linear pattern of symbols.

55. A game controller in accordance with claim 40, wherein the trigger condition is that a player must make an ante-bet of credit.

56. A computer program, comprising instructions for controlling a computer to implement a game controller in accordance with claim 40.

57. A computer readable medium, providing a computer program in accordance with claim 56.

58. A data signal, comprising a computer program in accordance with claim 56.

59. A game controller in accordance with claim 40, wherein the non-linear pattern does not extend across all the columns of the display.

* * * * *